United States Patent [19]

Gallet et al.

[11] Patent Number: 4,869,525

[45] Date of Patent: Sep. 26, 1989

[54] ANTI-FRICTION PLATE WHICH AUTOMATICALLY RECENTERS FOR SAFETY BINDING

[75] Inventors: Yvon Gallet, Annecy; Jean-Pierre Dimier, Rumilly, both of France

[73] Assignee: Salomon S.A., Annecy Cedex, France

[21] Appl. No.: 80,104

[22] Filed: Jul. 31, 1987

[30] Foreign Application Priority Data

Aug. 5, 1986 [FR] France ..... 86 11968

[51] Int. Cl.[4] ..... A63C 9/00

[52] U.S. Cl. ..... 280/636; 280/626; 280/628

[58] Field of Search ..... 280/618, 626, 628, 629, 280/636

[56] References Cited

U.S. PATENT DOCUMENTS

| | | | |
|---|---|---|---|
| 3,544,123 | 12/1970 | Werner et al. . | |
| 3,840,240 | 10/1974 | Covini | 280/629 |
| 4,170,372 | 10/1979 | Salomon | 280/626 |
| 4,178,014 | 12/1979 | Salomon | 280/629 |
| 4,337,965 | 7/1982 | Salomon | 280/628 |
| 4,398,747 | 8/1983 | Bernard et al. | 280/636 |
| 4,499,674 | 2/1985 | Olivieri | 280/636 |
| 4,516,792 | 5/1985 | Scheck et al. | 280/636 |
| 4,639,011 | 1/1987 | Rullier | 280/628 |
| 4,660,849 | 4/1987 | Sedlmair et al. | 280/625 |
| 4,709,942 | 1/1987 | Dimier et al. | 280/618 |

FOREIGN PATENT DOCUMENTS

| | | | |
|---|---|---|---|
| 1914546 | 10/1969 | Fed. Rep. of Germany . | |
| 2092844 | 1/1972 | France . | |
| 2334382 | 7/1977 | France . | |
| 2405723 | 5/1979 | France . | |
| 2411019 | 7/1979 | France . | |
| 2473328 | 7/1981 | France | 280/626 |
| 2540735 | 8/1984 | France . | |
| 2560778 | 9/1985 | France . | |
| 8503451 | 1/1985 | PCT Int'l Appl. . | |
| 0490871 | 5/1970 | Switzerland . | |

*Primary Examiner*—Charles A. Marmor
*Assistant Examiner*—Eric Culbreth
*Attorney, Agent, or Firm*—Sandler & Greenblum

[57] ABSTRACT

The anti-friction plate is guided by vertical and longitudinal guidance apparatus allowing for a free lateral movement. The free lateral extent of plate 1 is limited by the play of the lateral ramps of an opening 22 which is laterally movable with the anti-friction plate 1 and in which a spur 26 affixed to jaw 6 penetrates. Spur 26 assures the recentering of plate 1 when the jaw 6 returns to the centered position, and frees the plate when the jaw is pivoted.

49 Claims, 14 Drawing Sheets

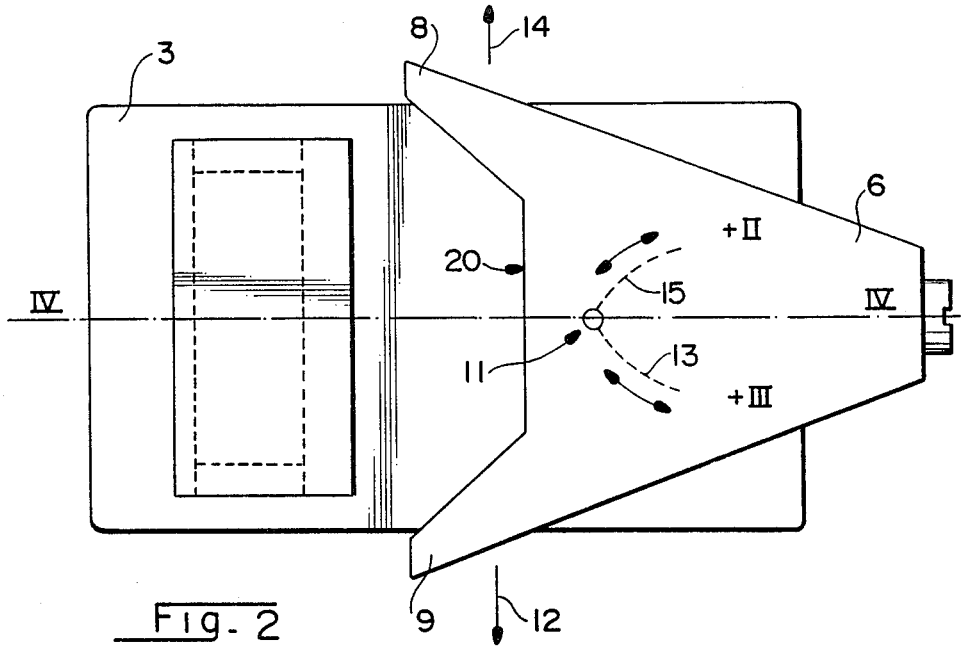
Fig. 2
Fig. 3
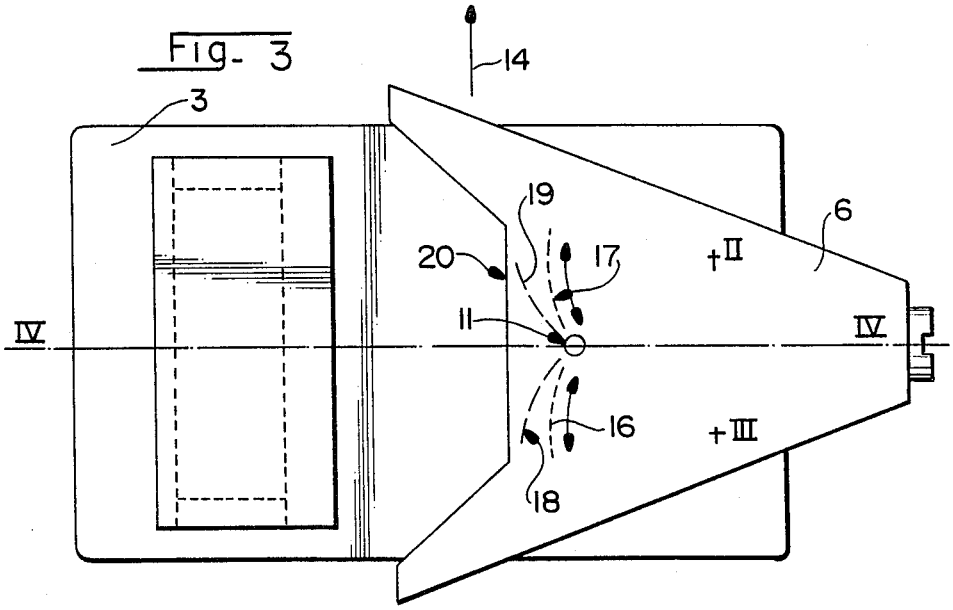

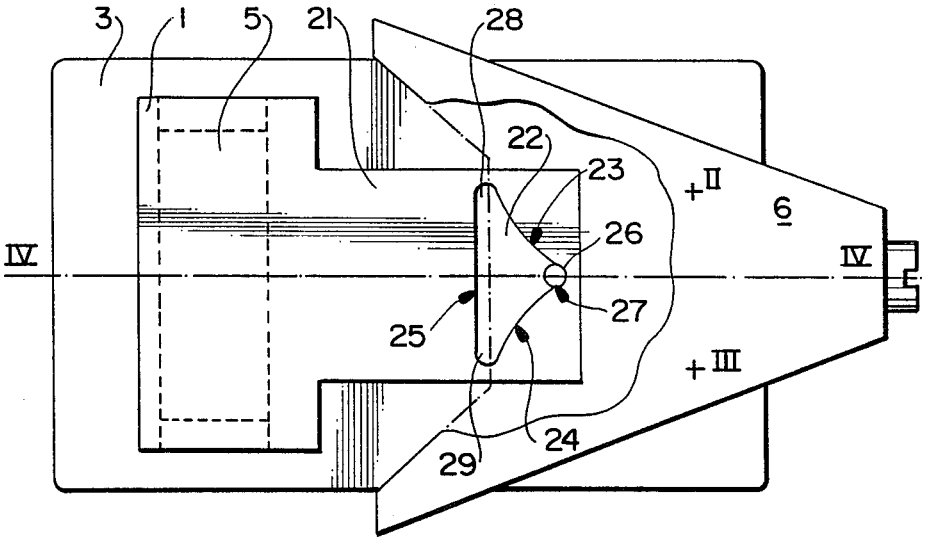
Fig. 4
Fig. 5
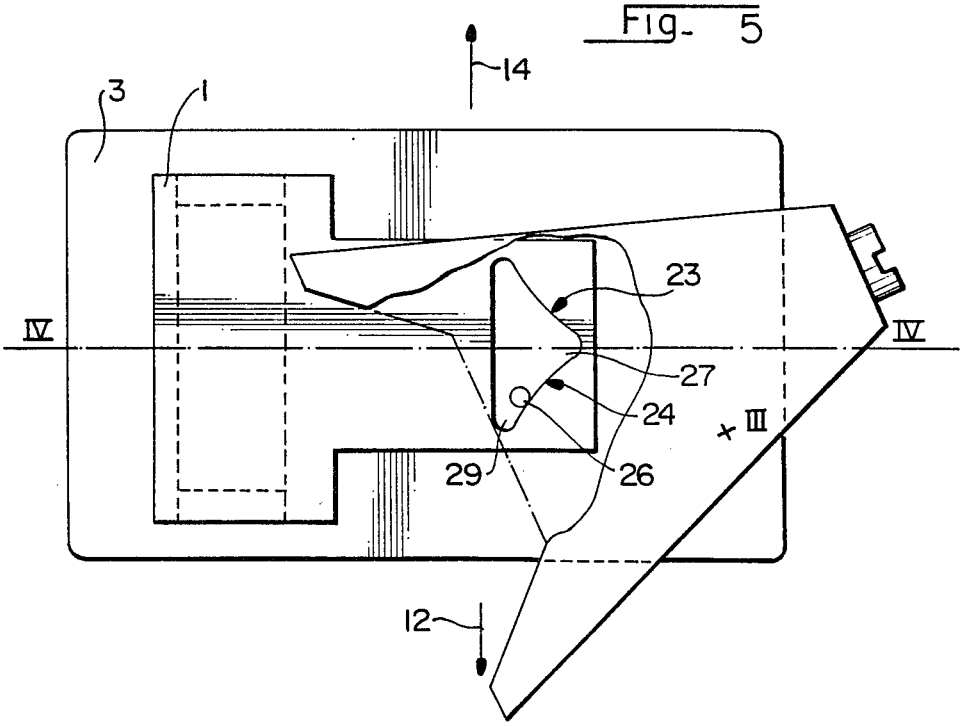

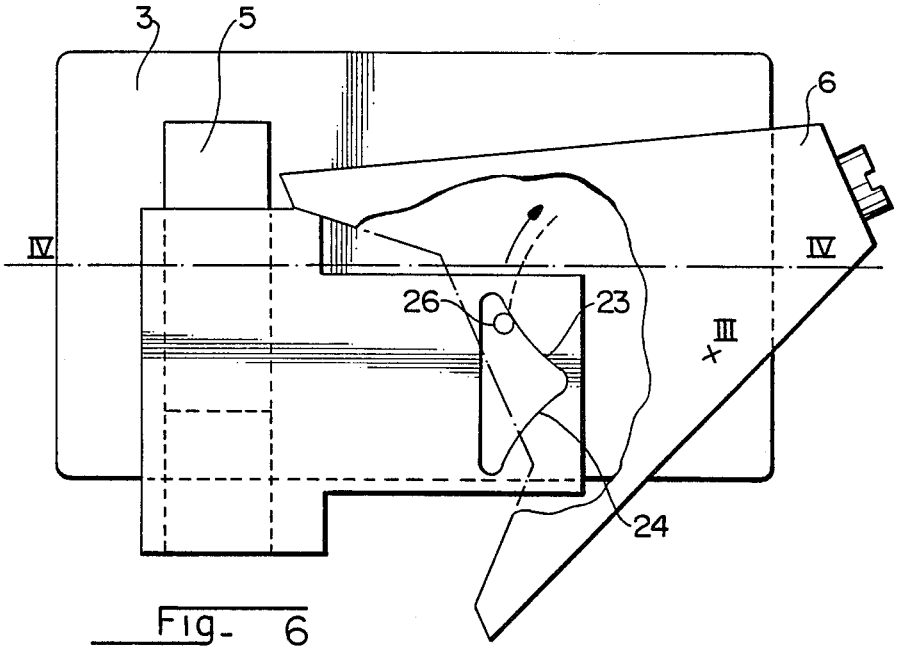
Fig. 6
Fig. 7
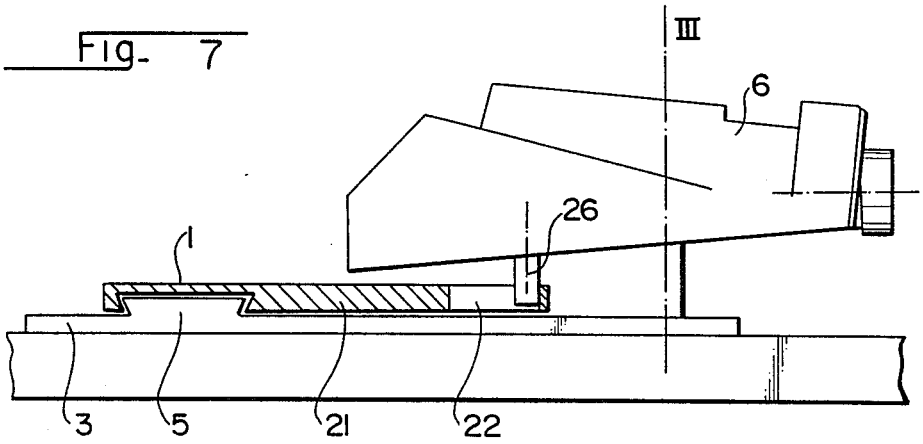

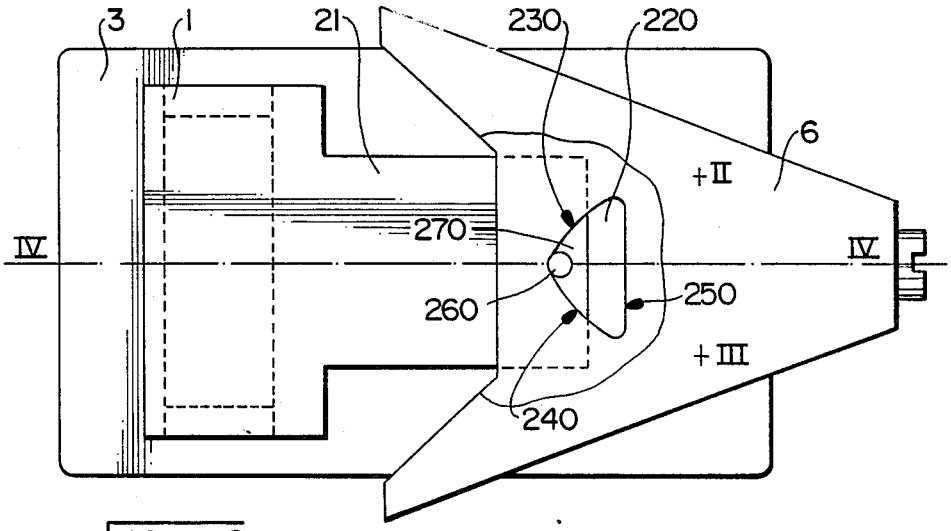
Fig. 8
Fig. 9
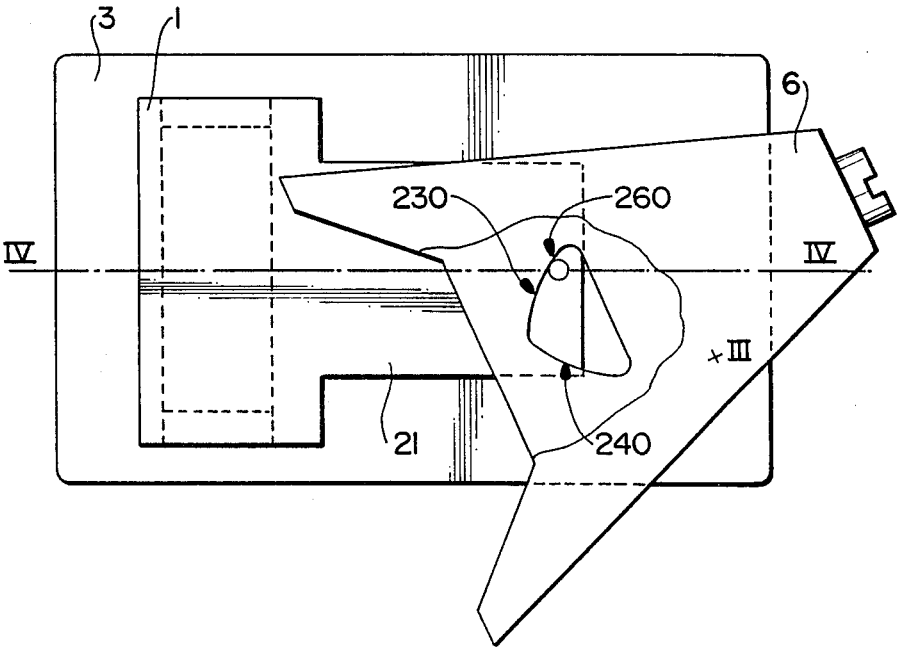

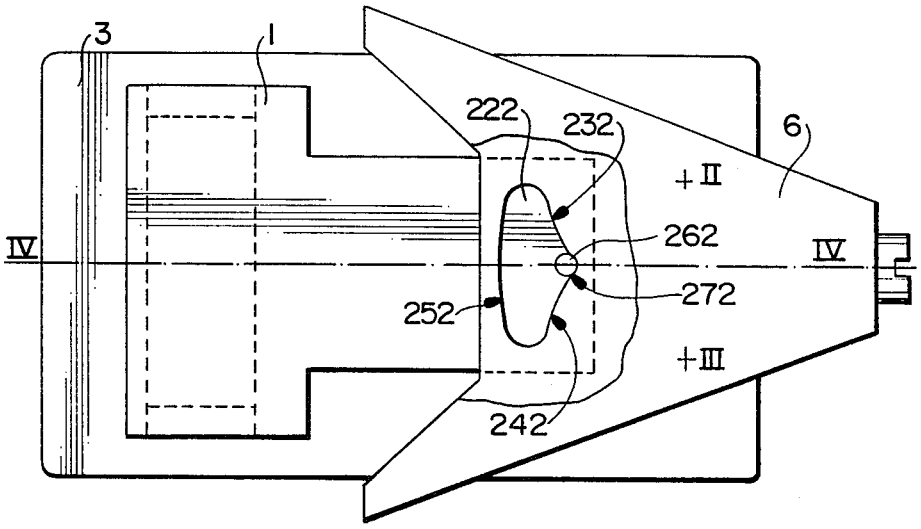
Fig. 13
Fig. 14
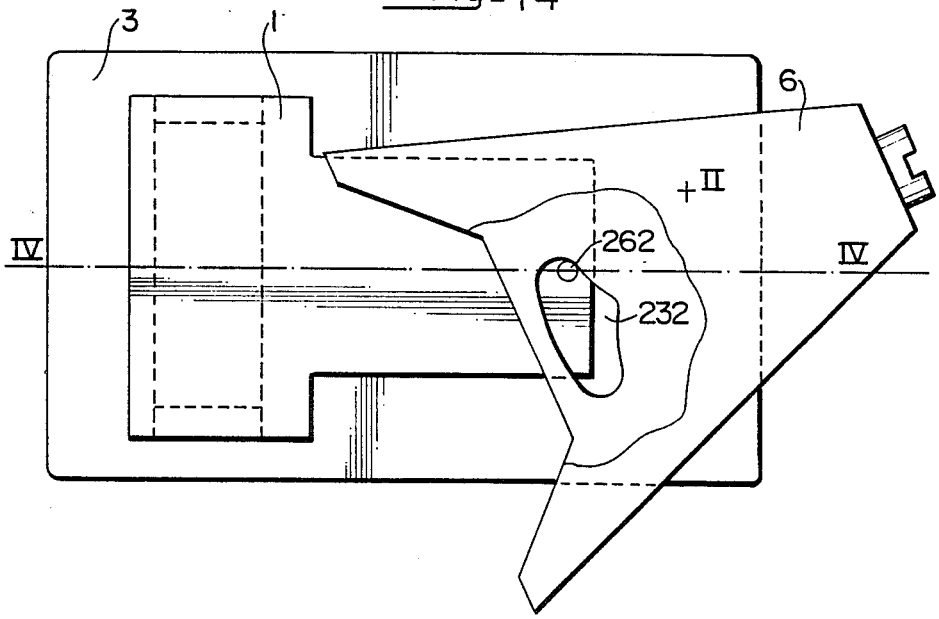

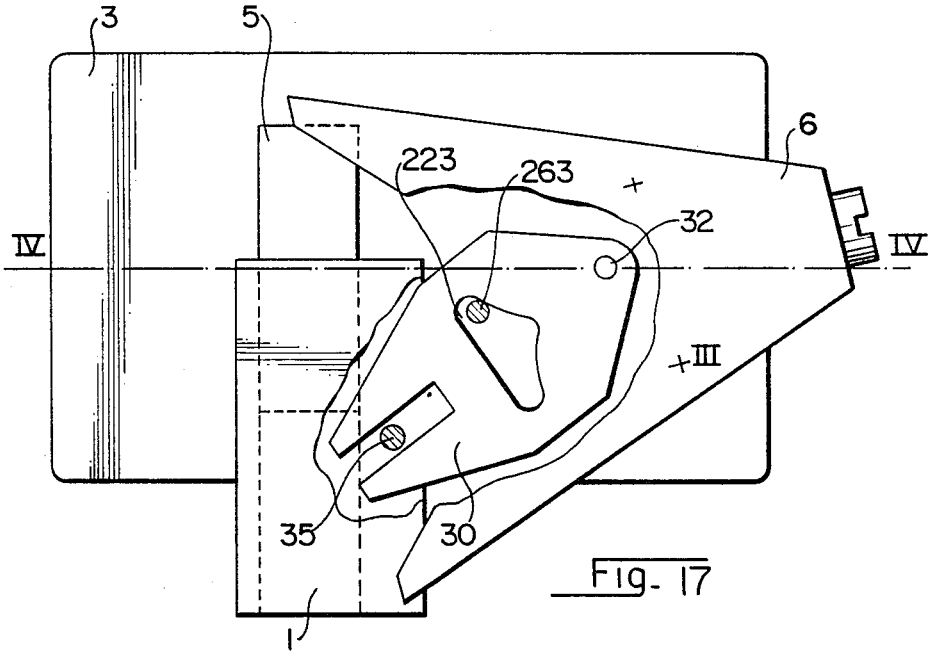
Fig. 17
Fig. 18
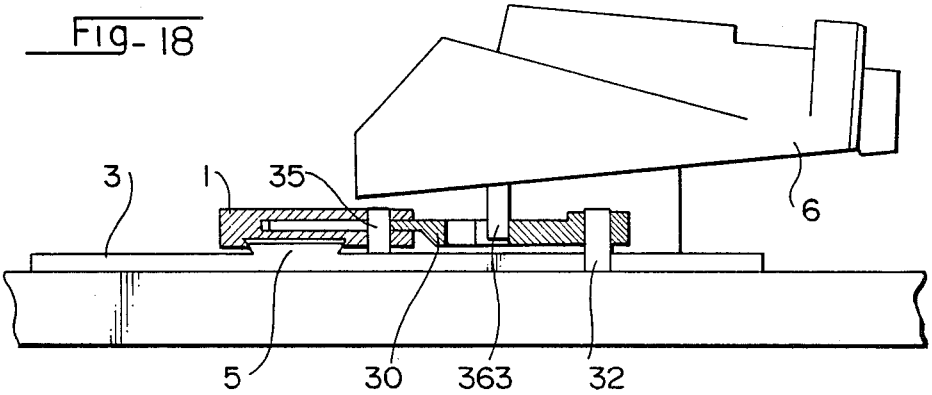

ANTI-FRICTION PLATE WHICH AUTOMATICALLY RECENTERS FOR SAFETY BINDING

BACKGROUND OF THE INVENTION

1. Field of the Invention

The present invention relates to safety bindings for skis adapted to maintain, in a laterally releasable fashion, one of the ends of a boot with respect to a ski. The binding according to the invention can retain either the front of the boot, or the rear, however it is particularly adapted to retain the front.

2. Description of Background and Relevant Information

A safety binding of the type referenced above assures the safety of a skier by responding, through its lateral release, to excessive torsional forces at the level of the leg of the skier. Safety bindings of the conventional type, having a lateral release, have a certain number of disadvantages, particularly when a torsional fall is combined with a frontward fall. In effect, during frontward displacement of the weight of the skier, the bottom of the sole of the boot which is at the level of the front of the foot is applied against the ski with a substantial force directed towards the ski, i.e., downwardly, which serves to create, between the bottom of the sole and the support surface of the ski, a substantial frictional force which opposes the lateral displacement of the boot.

There has long been sought a solution to the problem of safety bindings having a lateral release, so as to provide a binding which maintains the boot without moving during normal skiing in a stable maintenance position of the boot substantially in the longitudinal vertical median plane of the binding, and which is laterally releasable in a sure fashion by reducing to the maximum friction between the sole of the boot and the upper surface of the ski.

It has thus been proposed to glue to the surface of the ski a plate made of an anti-friction material, such as described in French Patent 2 092 844. However, cleats which may be provided under the sole of the boot considerably increase the friction, and accumulated dirt reduces its effectiveness.

To further reduce friction, it has been proposed to insert between the sole of the boot and the upper surface of the ski a moveable support plate adapted to be laterally displaced with the boot The sliding between the moveable plate and the skis is then not adversely affected by dirt or the cleats of the boot.

A first solution, described in document WO 85/03451, consists of utilizing plates affixed to the binding. However, in this first case, if ice forms between the plate and the ski, there is blockage of the binding, or at least a very substantial disturbance of its operation.

A second solution, described in Swiss Patent 490,871, consists of providing a rotating plate, positioned on the upper surface of the ski, and return biased to the central position by a re-centering spring The disadvantage is that, during release of the binding the boot pivots the plate against the energy of its re-centering spring. This energy adds to the energy of the binding, and increases the force which the leg must overcome in order to release from the binding.

SUMMARY OF THE INVENTION

The present invention has in particular as an object to provide a safety binding having an anti-friction plate which automatically recenters, in which the re-centering means of the anti-friction plate do not disturb the release of the binding and the movement of the boot, and in which the braking or the possible blockage of the anti-friction plate by ice do not hinder the release of the binding.

According to another object of the invention, the return of the anti-friction plate is assured by the binding itself, such that it does not require any supplemental return means.

Generally, the invention is directed to a safety binding comprising:

(a) a pivotable jaw adapted to pivot from a stable equilibrium position to release a ski boot, the pivotable jaw being biased for return to the stable equilibrium position;

(b) an anti-friction plate adapted for lateral movement transverse to the longitudinal median plane of the jaw; and (c) extent limiting means allowing for free lateral movement of the anti-friction plate upon lateral pivoting of the jaw, the extent limiting means defining the maximum extent of possible lateral movement of the anti-friction plate The extent limiting means further recenters the anti-friction plate upon return of the jaw to its stable equilibrium position.

The inventive system is applicable to bindings of the "engaging" and "disengaging" type (either single or double pivot).

The extent limiting means may comprise a spur mounted on one of the jaw or anti-friction plate, the spur cooperating with an opening on the other of the jaw or anti-friction plate whereby upon pivoting of the jaw from its stable equilibrium position the spur and opening move freely relative to one another whereby substantially no lateral forces are exerted on the anti-friction plate. The spur abuts against the surface forming the opening upon movement of the anti-friction plate to either of the maximum lateral extents of movement of the anti-friction plate.

The opening is, in certain embodiments generally triangular and is located in a forward extension of the anti-friction plate, with the spur extending from the jaw into the opening. In other embodiments the converse is the case.

The shape and orientation of the opening are functions of the movement that the jaw undergoes upon lateral pivoting. In one embodiment the opening is formed by lateral oblique concave ramps, while in others the ramps are convex in form. In these embodiments the spur is positioned to extend into an apex formed in the opening which allows for little play between the anti-friction plate and the opening.

According to another embodiment of the invention the extent limiting means comprises a linkage lever having first and second openings therein, the first opening being generally triangular with two lateral oblique walls converging towards an apex, and a second opening adjacent to the anti-friction plate. The anti-friction plate comprises a spur extending upwardly into the second opening to allow for longitudinal movement of the spur on the anti-friction plate in the second opening. The extent limiting means further comprises a second spur extending from the jaw into the first opening.

As to the anti-friction plate, in certain embodiments it can slide laterally only relative to the longitudinal median plane of the binding. In other embodiments the plate can slide laterally while pivoting around an axis generally perpendicular to the upper surface of the ski. The anti-friction plate may extend substantially the entire length of the sole of the ski boot. In this instance the anti-friction plate may comprise a heel binding movable with the anti-friction plate for securing the rear of the ski boot to a ski. The anti-friction plate comprises an opening at the end thereof opposite from the heel binding, and the jaw comprises a spur extending therefrom into the opening, the opening and spur constituting the extent limiting means.

In yet another embodiment the extent limiting means comprises a pair of connecting rods, a spur and at least one cooperating shoulder on the anti-friction plate. The pair of connecting rods being symmetrically positioned and pivotably mounted on opposite sides of the longitudinal median plane of the jaw. Each of the connecting rods comprises first and second arms. Each of the first arms cooperates with a shoulder of the anti-friction plate, and each of the second arms is configured to cooperate with the spur to determine the maximum extent of lateral movement of the anti-friction plate.

The precise configuration of the arms is, again, a function of the type and mode of operation of the binding.

Thus, in one case the first arms are configured and positioned to cooperate with exterior lateral surfaces of the at least one shoulder which is centrally positioned on the anti-friction plate.

In another instance the binding is of the "disengaging" type, and the first arms cooperate with lateral interior surfaces of opposite shoulders on the anti-friction plate.

BRIEF DESCRIPTION OF THE DRAWINGS

Other objects, characteristics and advantages of the present invention will become clear from the description which follows of a number of particular embodiments, given by way of non-limiting example with reference to the annexed drawings in which:

FIG. 2 illustrates, in top view, a front binding of the "disengaging" type;

FIG. 3 illustrates, in top view, a binding of the "engaging" type;

FIGS. 4–7 illustrate an embodiment having a sliding plate and spur affixed to the jaw, on a binding of the "engaging" type;

FIGS. 8–10 illustrate an embodiment having a sliding anti-friction plate and spur affixed to the plate, on a binding of the "engaging" type;

FIGS. 13 and 14 illustrate one embodiment having a slideable anti-friction plate with a spur affixed thereto, on a "disengaging" type binding;

FIGS. 15–18 illustrate one embodiment of a slideable anti-friction plate and a linkage between the jaw and the plate by a pivotable intermediate element;

DESCRIPTION OF PREFERRED EMBODIMENTS

Figure 1:
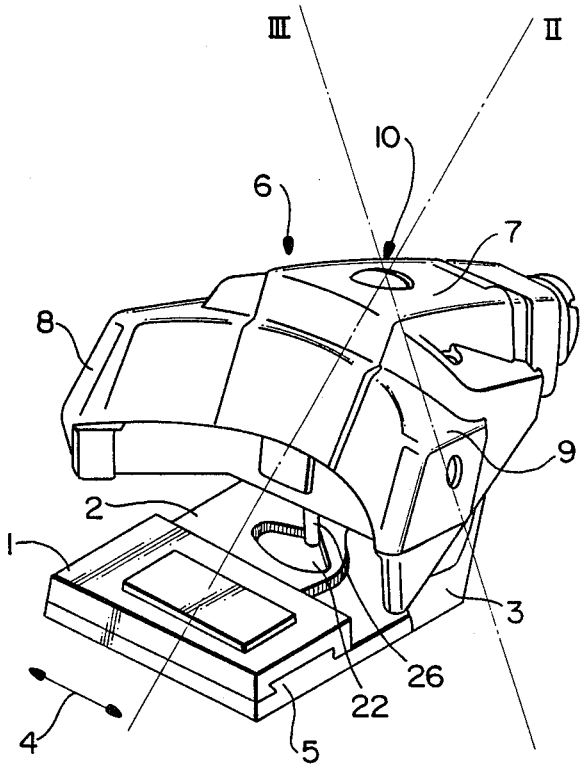
FIG. 1 is a perspective view of a front binding provided with an anti-friction plate according to the invention.

The solution according to the present invention is preferably applicable to bindings comprising a monoblock jaw having a lateral release associated with an anti-friction plate. A first type of monoblock binding comprises a jaw pivotally mounted on a single vertical fixed axis affixed to the platform of the binding The jaw thus allows for a pure rotational movement around a vertical or substantially vertical axis.

In the more recent types of monoblock binding, such as described for example in French Patent 2 334 382, the jaw is pressed, under the action of an elastic mechanism, against two lateral lines of support respectively positioned on both sides of a longitudinal plane of symmetry of the binding, in a manner such that the jaw can pivot around one line of support as well as the other. When the lines of support are vertical, the jaw allows for two distinct rotational movements around different vertical axes, depending upon the direction of the force.

An improvement of these bindings, described in the same French patent, consists of orienting the two lines of support to upwardly converge. In this case, the rear portion of the jaw, in the course of pivoting movement around one of the lines of support during a release operation, lifts slightly in the direction of the release.

In the above bindings, the jaw is supported from the rear to the front against two converging lateral lines of support of a support element affixed to the platform of the binding. The jaw pivots on the line of support which is to the right of the longitudinal median plane of the binding in the case of a rightward release, and pivots on the left line of support relative to the median plane in the case of a leftward release. The offsets of the lines of support produce during a pivoting, a slight retraction of the jaw. Such a binding is of the "engaging" type.

Another type of binding having a monoblock jaw is described in French Patent 2 540 735. In this patent the jaw is pressed from front to rear against two lateral converging lines of support of a support element, against which it is maintained by elastic means. During a rightward release, the jaw pivots around the line of support situated to the left of the longitudinal median plane of the binding, and, conversely, during a release to the left, the jaw pivots around the line of support situated to the right of the median plane. This characterizes the jaw as being of the "disengaging" type, which, during a pivoting from a centered maintenance position, tends to advance to free the boot.

According to the present invention, the anti-friction plate is guided by vertical and longitudinal guidance means allowing for free lateral movement. The free lateral extent of movement of the anti-friction plate is limited on both sides by first and second extent limiters respectively defining first and second extreme positions of the anti-friction plate. The first and second extent limiters are moveable and controlled by the jaw of the binding in a manner such that each extreme position of the anti-friction plate along a transverse direction has, with respect to the longitudinal median plane of the binding, a spacing which increases as a function of the pivoting of the jaw along the same transverse direction with respect to its centered equilibrium position. In this way, the pivoting of the jaws towards the exterior frees the anti-friction plate in the same direction of progression without moving it, allowing simply for its free movement, and the return of the jaw towards the interior tends to recenter the anti-friction plate, progressively limiting its movement.

According to one embodiment, in the centered stable maintenance position of the boot, the first and second extent limiters maintain the plate in the central position with no or little play.

Depending upon the type of monoblock binding which one utilizes for performing the present invention, the means for controlling the position of the extent limiters as a function of the position of the jaw will be different, and the present invention provides a plurality of exemplary embodiments.

According to a first embodiment, the binding is of the "engaging" type, having two laterally offset pivots. The jaw comprises a spur, of substantially vertical axis, positioned on the rear portion of the jaw, engaging in an appropriate opening which is laterally moveable with the anti-friction plate. The opening comprises two oblique lateral ramps spaced from one another towards the rear from a central front apex. The ramp surfaces border the extent of movement that the spur follows during the movements of the jaw. In this way, when the jaw is in the stable centered maintenance position, the spur is lodged in the central apex of the opening. When the jaw pivots from the centered position to a lateral released position, the opening remains fixed, the spur moves along the length of the corresponding lateral oblique ramp of the opening without exerting a substantial mechanical action on this ramp. The lateral movements of the anti-friction plate are thus limited between the two extreme positions in which one or the other of the lateral oblique ramps of the opening rests on the spur. The spur assures the return of the anti-friction plate into the centered position, during the return of the jaw to the centered position.

According to another embodiment, the binding is of the "disengaging" type, having two laterally offset pivots. The jaw comprises a spur having a substantially vertical axis, positioned in the posterior portion of the jaw, engaging in an appropriate opening which is laterally moveable with the anti-friction plate. The opening comprises two oblique lateral ramps which space apart from one another towards the front from a central posterior apex, the ramps bordering the extent that the spur follows during the movements of the jaw. In this way, when the jaw is in the centered stable equilibrium maintenance position, the spur is lodged in the central apex of the opening. When the jaw pivots from the centered position to a lateral release position, the opening remaining fixed, the spur moves along the length of the corresponding oblique lateral ramp of the opening without exerting a substantial mechanical action on this ramp. The lateral movements of the anti-friction plate are thus limited between the two extreme positions in which one or the other of the lateral oblique ramps of the opening rests on the spur. The spur assures the return of the anti-friction plate to the centered position during the return of the jaw to the centered position.

According to a third embodiment, the binding is of the "engaging" type having two laterally offset pivots. The binding comprises a spur which is laterally moveable with the plate, of substantially vertical axis, engaging in an opening of appropriate form provided in the posterior portion of the jaw. The opening comprises two lateral oblique ramps which are spaced from one another towards the front beginning at a central posterior apex. During the movements of the jaw, the lateral oblique ramps move past the central position of the spur. In this way, when the jaw is in the centered stable maintenance position, the spur is lodged in the central apex of the opening. When the jaw pivots from the centered position to a lateral release position, the spur remaining fixed, the lateral oblique corresponding ramp of the opening moves past while facing the spur without exerting on it substantial mechanical action. The lateral movements of the anti-friction plate are thus limited between two extreme positions in which the spur rests respectively on one or the other of the lateral oblique rampes of the opening. The ramps assure the return of the spur and of the anti-friction plate to the centered position during the return of the jaw to the centered position.

According to yet another embodiment, the binding is of the "disengaging" type having two laterally offset pivots. The binding comprises a spur which is laterally moveable with the plate, having a substantially vertical axis, engaged in an opening of appropriate shape provided in the posterior portion of the jaw. The opening comprises two oblique lateral ramps which are spaced towards the rear from a central frontward apex. The oblique ramps are extended by secondary ramps. During the movements of the jaw, the lateral oblique ramps move adjacent to the centered position of the spur. In this way, when the jaw is in the stable central maintenance position, the jaw is positioned in the central apex of the opening. When the jaw pivots from the centered position to a lateral release position, the spur remains fixed, the corresponding lateral oblique ramp of the opening moves facing the spur without exerting a substantial mechanical force on it. The lateral movements of the anti-friction plate are thus limited between two extreme positions in which the spur rests on one of the lateral oblique ramps of the opening or on a secondary ramp. The ramps assure the return of the spur and the anti-friction plate to the centered position during the return of the jaw to the centered position.

According to another embodiment, the binding is either of the single pivot type, or of the "disengaging" type having two laterally offset pivots The binding comprises two opposite moveable extent limiters positioned on both sides of the median longitudinal plane of the binding. Each extent limiter is constituted by a first arm of a connecting rod having two connected arms. The connecting arm is pivotably mounted along its intermediate portion on a vertical shaft affixed to the binding platform The first arm cooperates through its lateral exterior surface with the lateral interior surface of a lateral shoulder corresponding to the anti-friction plate. The second arm is oriented to rest to the rear against a spur positioned on the rear portion of the jaw, and is shaped to border the extent of movement that the spur undergoes during the pivoting of the jaw in its direction.

According to another embodiment, the binding is of the "engaging" type, having two laterally offset pivots. The binding comprises two moveable extent limiters positioned facing one another on both sides of the longitudinal median plane of the binding. Each moveable extent limiter is constituted by a first arm of a connecting rod having two connected arms, pivotably mounted at its intermediate portion on a vertical shaft affixed to the binding platform. The first arm cooperates through its interior lateral surface with the exterior lateral surface of a central shoulder of the anti-friction plate. The second arm is oriented to rest in front against a spur positioned at the rear portion of the jaw, and is shaped to border the extent that the spur follows during the pivoting of the jaw in the opposite direction.

In the embodiments having a spur and opening, in which the spur is affixed to the jaw, the opening can be provided either directly on the anti-friction plate, or on a distinct intermediate element which transits lateral return movements to the centered position to the anti-friction plate. The distinct intermediate element can preferably be a lever, pivotably mounted on a vertical shaft affixed to the binding platform along a first edge, its second end cooperating with the anti-friction plate to which it is affixed in lateral displacement. The opening is a slot positioned in the intermediate position on the lever. Such a positioning of the lever can be advantageous because it allows for displacements of greater amplitude by the anti-friction plate.

In the embodiments in which the spur is connected in transverse displacement to the anti-friction plate, the spur can be mounted either directly on the plate itself, or on a distinct intermediate element. As in the previous case, the intermediate distinct element can preferably be a rotatably mounted lever, which allows for a greater amplitude of the movement of the anti-friction plate.

In the embodiments in which the spur is connected in transverse displacement to the anti-friction plate, the spur can be mounted either directly on the plate itself, or on a distinct intermediate element. As previously, the intermediate distinct element can preferably be a rotatably mounted lever which allows for a greater amplitude of movement of the anti-friction plate.

The Figures illustrate one ski binding adapted to maintain the front end of the boot. The sole of the boot rests on an anti-friction plate 1 positioned on the upper surface 2 of a platform 3 of the binding, the platform 3 being adapted to be affixed on the upper surface of a ski. According to a first embodiment, plate 1 is slidably mounted on platform 3 for a translational transverse movement schematically shown by the double arrow 4, guided in its movement by dove-tail tracks 5. For this, platform 3 comprises, on its upper surface, a rib having a corresponding dove-tail profile engaging in a corresponding groove provided in the lower surface of anti-friction plate 1.

The binding comprises a monoblock jaw 6 comprising a principal portion 7 having, on its rear portion, two lateral wings 8 and 9 forming an encasing structure for the lateral and vertical maintenance of the boot. Monoblock jaw 6 can form a rigid single element with the principal portion 7 and wings 8 and 9, or it can comprise a principal portion 7 on which are journalled two wings 8 and 9 which can retract to allow for escape.

Jaw 6 is movably pivotably mounted on fixed platform 3, on both sides of a centered stable equilibrium position shown in FIG. 1, towards which it is biased by elastic return means (not shown).

Figure 25:
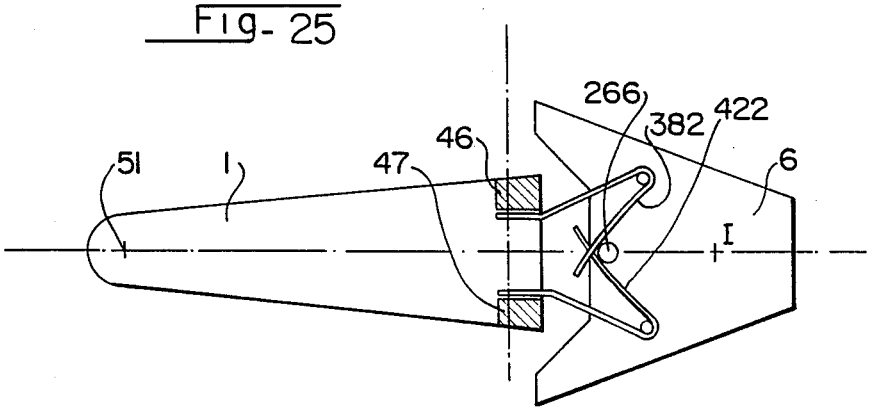
FIGS. 25–27 illustrate one similar embodiment having connecting rods for a single axis binding.
Figure 26:
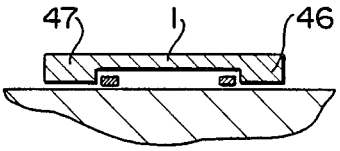
Figure 27:
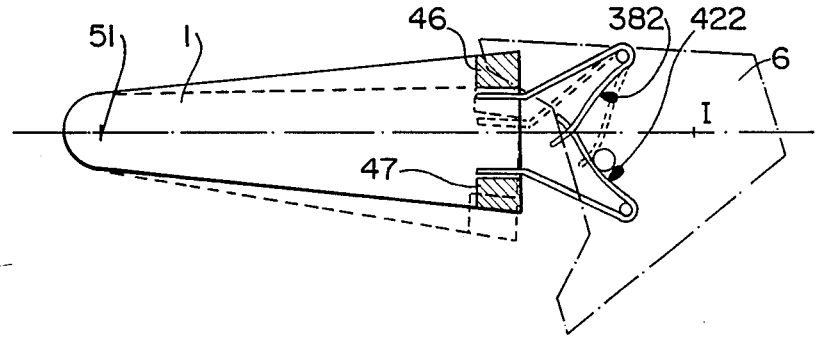

According to a first constructional embodiment, the pivoting of jaw 6 can occur around a single axis I, such as is shown for example in FIGS. 25 and 27. According to a second embodiment, the pivoting of jaw 6 can occur around off-centered axes II and III, the axes converging upwardly at a junction point 10, such as is shown for example in FIG. 1. Depending upon the configuration of the pivot axes II and III relative to the binding body, and their method of support, the binding will be of the "engaging" or "disengaging" type.

According to the invention, the lateral movement of the anti-friction plate 1 is limited by extent limiting means. Between two extreme positions, the movement of the anti-friction plate 1 is free. The extreme positions that the anti-friction plate can assume depend, at each point in time, on the position of jaw 6 around its axes. The means which assures the dependency between the movement of the anti-friction plate and the position of jaw 6 are different depending upon the type of movement which the jaw will undergo. Two types of rotational movement of the jaw are illustrated in FIGS. 2 and 3. In FIG. 2, the binding is of the "disengaging" type, and the movement of a point 11 of the jaw is shown. In the Figure, jaw 6 is in the stable centered position, in a vertical longitudinal median plane IV—IV of the binding which corresponds to the normal maintenance position of the boot, parallel to the ski. Starting from this centered position, when the boot impresses on jaw 6 a lateral bias towards the right as shown by arrow 12, jaw 6 turns around left axis II and point 11 follows the trajectory shown by the dashed lines 13.

Conversely, during a leftward bias in the direction of arrow 14, point 11 follows trajectory 15, jaw 6 turning around right axis III. When axes II and III are vertical, trajectories 13 and 15 are arcs of a circle whose center of rotation is respectively on axes II and III. When axes II and III converge, trajectories 13 and 15 are slightly different, their projection on the horizontal plane of platform 3 being elliptical.

In an analogous fashion, FIG. 3 illustrates the trajectories of point 11 for a binding of the "engaging" type. During a bias towards the right along arrow 12, jaw 6 pivots around right axis III and point 11 follows trajectory 16. During a leftward bias in the direction of arrow 14, jaw 6 pivots around the left axis II, and point 11 follows trajectory 17. In the case of vertical axes II and III, the trajectories 16 and 17 are circular and centered respectively around axes III and II. When axes II and III converge, the trajectories are slightly different, shown by the dashed lines 18 and 19, point 11 tending to space itself progressively from the corresponding axis as the pivoting increases.

In a first embodiment, shown in FIGS. 4–7, the anti-friction plate is mounted to slide laterally, as in FIG. 1, on tracks 5 which are schematically shown. The plate comprises an advanced portion 21, extending beneath jaw 6, and comprising an opening 22 of appropriate shape and position. Opening 22, in this embodiment, is a slot defined by a first lateral oblique ramp 23, a second lateral oblique ramp 24, and a rear edge 25. Opening 22 is positioned beneath the posterior portion of jaw 6, as the figures show, to receive a spur 26 affixed to the jaw and positioned in its rear portion substantially in the position of point 11 of FIGS. 2 and 3.

First ramp 23 and second ramp 24 which are oblique diverge towards the rear, and meet in front at a front apex 27 in which spur 26 positions itself when jaw 6 is in the centered position shown in FIG. 4. The binding is of the "engaging" type, similar to that shown in FIG. 3.

In practice, in the embodiments having a spur affixed to the jaw, the shape and length of the ramps are selected as a function of the trajectory that the spur follows between the two release positions of the jaw, towards the right and towards the left. Over the entire length of this trajectory, when anti-friction plate 1 is in the centered position, spur 26 must rest within opening 22 without resting against ramps 23 and 24. First ramp 23 has a shape similar to the trajectory 19 of point 11 shown in FIG. 3, and second ramp 24 has a shape similar to trajectory 18 of FIG. 3. Ramps 23 and 24 are slightly offset towards the exterior, with respect to the trajectories 19 and 18, to take into account the thickness of spur 26. Ramps 23 and 24 continue until lateral apices 28 and 29 whose offset is determined as a function of the useful amplitude of the pivoting of jaw 6, an amplitude making it possible to reach the released positions.

One can preferably give to ramps 23 and 24 a shape such that they are parallel to the trajectory which spur 26 follows when jaw 6 pivots and when anti-friction plate 1 remains centered. One can however select slightly different equivalent shapes on the condition that the modifications do not prevent the reciprocal guidance of the spur and of the ramps during the re-centering of the anti-friction plate.

The shapes shown in the figure constitute a limiting interior shape for ramps 23 and 24. At each point, ramps 23 and 24 must be offset by a distance at least equal to the radius of the spur, with respect to trajectories 18 and 19, respectively in order to be able to accommodate the spur.

When the apex of the opening has the same dimension as the spur, the anti-friction plate is maintained in the centered position and without play. When the apex is slightly wider than the spur, the anti-friction plate can oscillate along a limited play when the jaw is in the centered position.

The above considerations concerning possible shapes of openings 22 applies not only to the embodiment of FIGS. 414 7, but likewise to all the other embodiments according to the invention. For the clarity of this explanation, only the ramps having shapes which are as close together and parallel to the trajectories shown in FIGS. 2 and 3 are described, with an apex assuring a centering without play. Quite clearly, other configurations are possible without departing from the scope of the invention.

The operation of the apparatus will now be described. Beginning with the centered position shown in FIG. 4, it is assumed that jaw 6 pivots toward the right, in the direction of arrow 12, around axis III, as a result of biases exerted by the boot. In the course of this pivoting, spur 26 moves along the second ramp 24 in the direction of apex 29. If the anti-friction plate 1 is not subjected to any lateral exterior force, it remains in the centered position shown in FIG. 5. As ramp 24 has substantially the same shape as the normal trajectory of spur 26, the spur does not exert any substantial mechanical action on ramp 24, and on anti-friction plate 1. When jaw 6 is pivoted, for example in the position shown in FIG. 5, spur 26 is spaced from the first ramp 23, such that the anti-friction plate 1 can freely be displaced towards the right, in the direction of arrow 12, until reaching an extreme position shown in FIG. 6, in which ramp 23 abuts against spur 26. Thus, in the pivoted position of FIGS. 5 and 6, the anti-friction plate 1 can freely oscillate in translation between the centered position shown in FIG. 5 and the off-center position shown in FIG. 6.

During the return of jaw 6 towards the centered position, beginning from the pivoted position of FIG. 6, spur 26 follows the same trajectory in reverse. If the anti-friction plate 1 is already in the centered position, spur 26 simply moves along ramp 24 without acting on the anti-friction plate. On the other hand, if the anti-friction plate is off-centered, for example as is shown in FIG. 6, spur 26 slides against ramp 23 until reaching apex 27 in the centered position of the jaw.

Of course, a rotation towards the left in the direction of arrow 14 produces a symmetrical displacement of spur 26 the length of ramp 23, and a return of the anti-friction plate by action of spur 26 on ramp 24.

FIG. 7 illustrates a partial longitudinal cross-sectional view along the median longitudinal vertical plane IV—IV of the binding, the jaw 6 being in the centered position. It is seen that spur 26 is a cylindrical pin or shaft having a substantially vertical axis, passing beneath the rear portion of jaw 6 to engage in opening 22. Slides 5 are schematically shown, and al variations are possible to assure an adequate guidance of the anti-friction plate 1.

Figure 10:
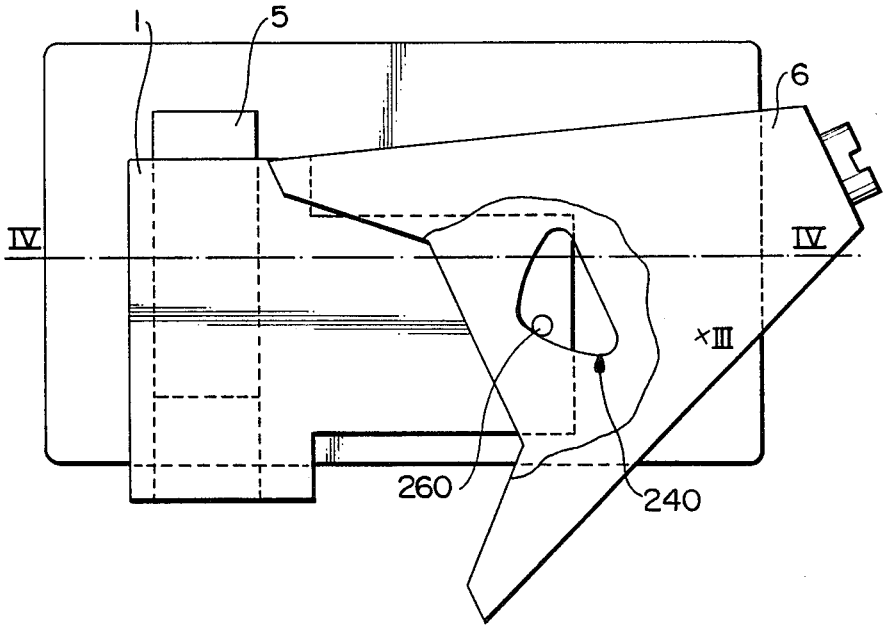

In the embodiment described in FIGS. 8–10, the binding is of the same type as that of FIGS. 4–7, and only the elements which differ from this first embodiment will be described. In FIGS. 8–10, the linkage between jaw 6 and anti-friction plate 1 is assured by means of a spur 260 affixed to extension 21 of anti-friction plate 1, and engaged in an opening 220 provided in jaw 6. In this embodiment, opening 220 is limited by a first oblique lateral ramp 230 and a second oblique lateral ramp 240 which diverge towards the front and meet towards the rear at a rear central apex 270. A third edge 250 closes the opening, as shown in FIG. 8. When the binding is in the centered position shown in FIG. 8, spur 26 is substantially in the centered position of point 11 shown in FIG. 2. First ramp 230 is parallel to trajectory 15 which point 11 follows during a leftward pivoting, and ramp 240 is parallel to trajectory 13 which point 11 follows during a rightward pivoting.

The operation of the apparatus will now be described. In the centered position, spur 260 is positioned in the apex 270 of opening 220. Beginning with this centered position, assuming that jaw 6 pivots towards the right as shown in FIG. 9, under the action of a bias of the boot, the opening 220 is displaced with respect to the spur in a manner such that its first ramp 230 moves around the initial position of spur 260. Thus, if the anti-friction plate 1 is not subjected to exterior lateral force, it remains in the centered position as shown in FIG. 9, and spur 260 does not undergo any mechanical bias of ramp 230, remaining freely in the opening 220.

In the pivoted position, shown in FIG. 9, ramp 240 is spaced from spur 260, which can displace to reach a second extreme position, shown in FIG. 10, in which anti-friction plate 1 is laterally displaced in the same direction as jaw 6. In this position, spur 260 abuts against ramp 240.

Beginning with the position of FIG. 10, during return of the jaw 6, ramp 240 pushes spur 260 and the anti-friction plate to bring them back to the center position shown in FIG. 8, the spur 260 being in the apex 270.

In the embodiments of FIGS. 11–14, the binding is of the "disengaging" type. The anti-friction plate 1 has the same structure as that of the preceeding embodiments, and the linkage between jaw 6 and the plate is assured by a spur and an opening.

Figure 11:
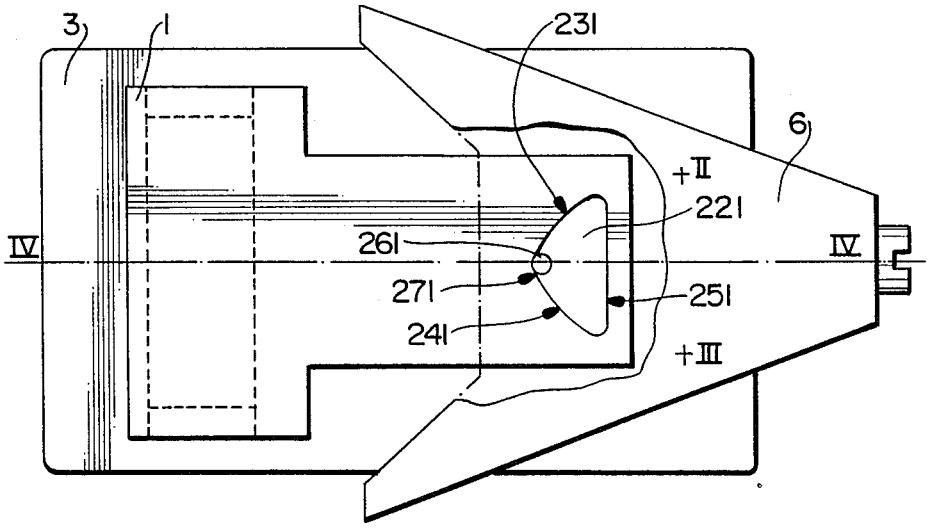
FIGS. 11 and 12 illustrate one embodiment of a sliding anti-friction plate and spur affixed to the jaw on a "disengaging binding"
Figure 12:
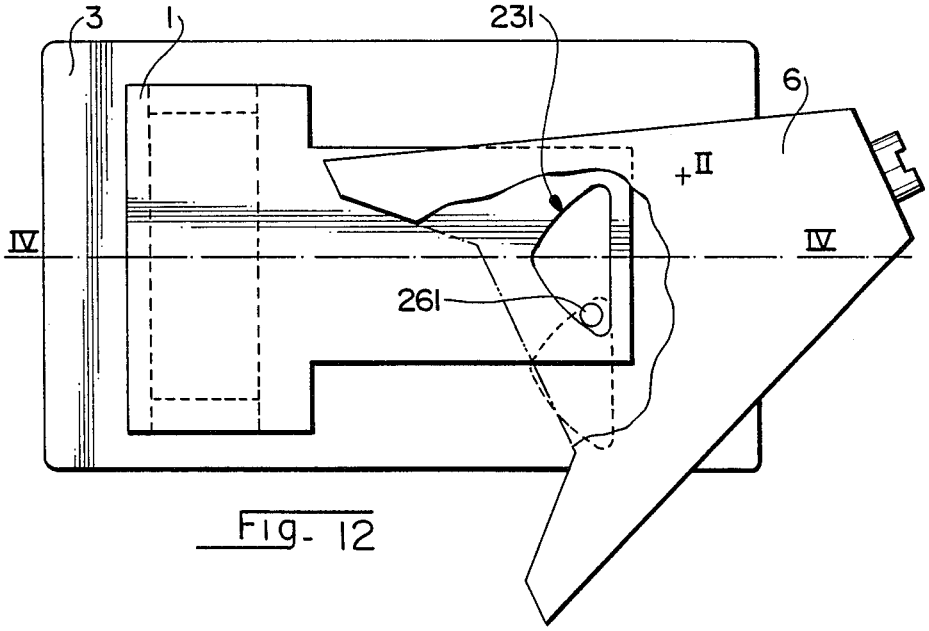
Figure 15:
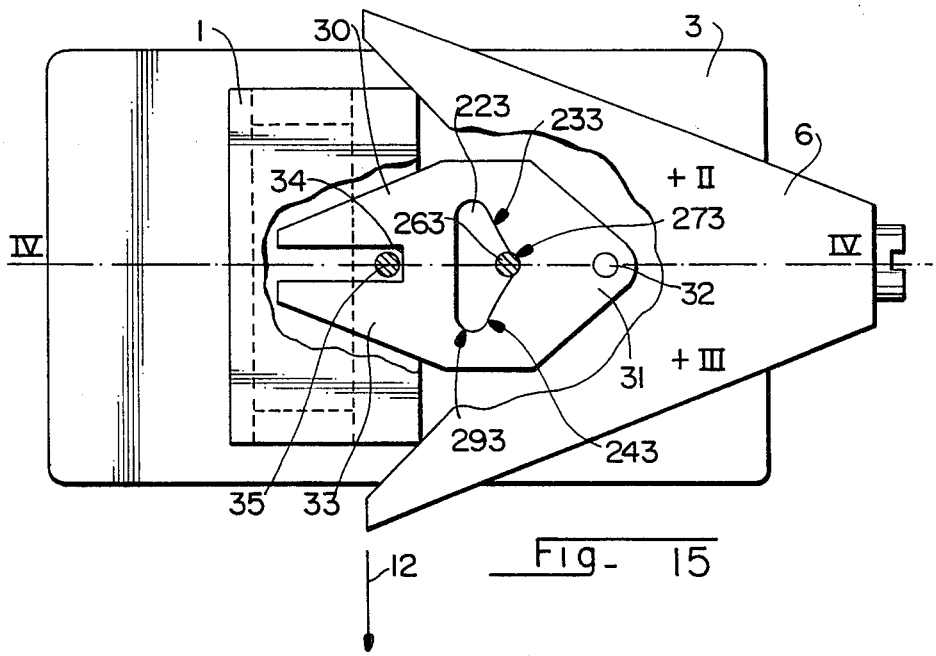
Figure 16:
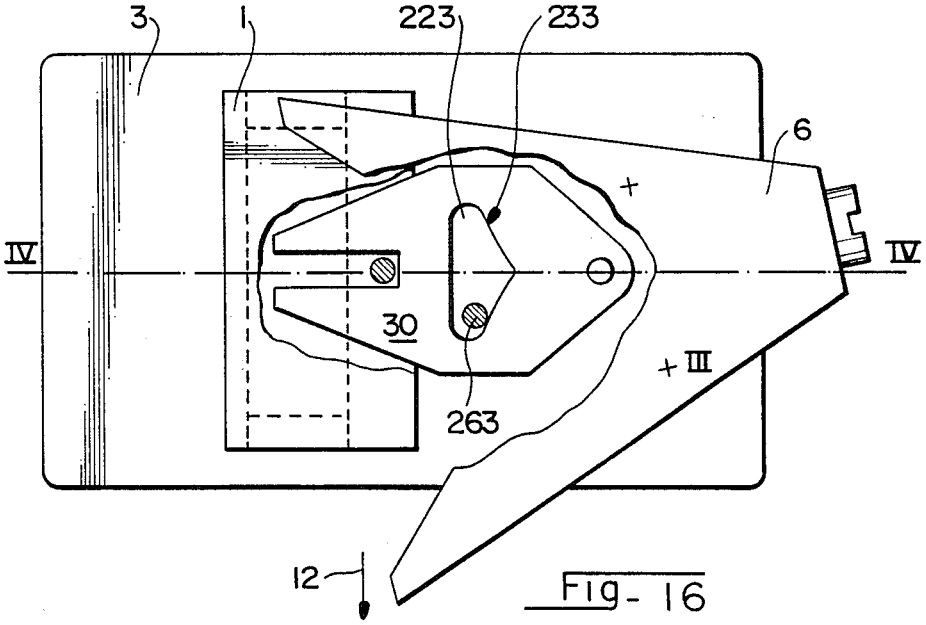

In FIGS. 11 and 12, spur 261 is affixed to jaw 6, and displaces in opening 221 provided in the jaw 6. In this case, opening 221 is limited by a first ramp 231 and a second ramp 241 which is oblique and diverges towards the front beginning at apex 271, the opening 221 being defined by a third side 251. Ramp 231 has a shape parallel to the trajectory 15 of FIG. 2 and ramp 241 has a shape parallel to trajectory 13 of FIG. 2.

During a rightward pivoting as is shown in FIG. 12, spur 261 moves along the length of ramp 241 without forcing the displacement of the anti-friction plate 1. In this position, the spur frees the plate which can be laterally displaced towards the right until ramp 231 abuts against spur 261. Upon return of jaw 6, spur 261 slideably presses against ramp 231 and brings back the anti-friction plate 1 to the centered position.

In FIGS. 13 and 14, spur 262 is affixed to the anti-friction plate 1, and penetrates into opening 222 of jaw 6. Opening 222 comprises a first ramp 232 and a second ramp 242 which are oblique and converge toward the front until an apex 272, the secondary ramps 252 defining the opening and extension of ramps 232 and 242. In this embodiment, ramp 232 has a contour substantially parallel to the trajectory 19 of FIG. 3, and ramp 242 has a contour substantially parallel to the trajectory 18 of FIG. 3.

During a pivoting of jaw 6 towards the right, as shown in FIG. 14, ramp 242 moves along spur 262 without displacing anti-friction plate 1, but while still allowing the spur 262 to then move freely towards the right until a limit position defined by the other secondary ramps 252 of opening 222. Upon return of the jaw, the ramps of the opening bring back spur 262 and anti-friction plate 1 into the centered position.

In the embodiments which have preceded, as well as in those which follow, the lateral ramps of the openings are defined as having a shape substantially identical to the trajectories of point 11 of FIGS. 2 and 3. One can likewise provide a slightly larger opening, allowing for a slightly greater play for the anti-friction plate, but assuring nevertheless its approximate centering when the binding returns to the centered position.

In the embodiments which have previously been described, anti-friction plate 1 is directly controlled by the spur or by the opening of jaw 6. This linkage can however be indirect, and can occur through one or more distinct intermediate elements. Thus, in FIGS. 15–18, one embodiment is shown, applied to a "engaging" type of binding whose jaw carries the spur, and an embodiment in which the linkage between the jaw and the anti-friction plate 1 occurs through a lever. Such a linkage including a lever can be easily envisioned for each of the other embodiments previously described.

In FIGS. 15–18, spur 263 is mounted at the rear portion of jaw 6, as in the embodiment of FIGS. 4–7. Spur 263 engages in opening 223 provided in the intermediate portion of a lever 30. The first, or front end of lever 30 is journalled around a vertical shaft 32 affixed to platform 3 of the binding. The second or rear end 33 of the lever, is operatively affixed to the anti-friction plate 1 for transverse movement. In the embodiments shown, the second end 33 of lever 30 comprises a median longitudinal cut-out 34 in which is engaged with small lateral play a vertical (pin) 35 which is affixed to anti-friction plate 1. During rotation of lever 30, pin 35 longitudinally slides in cutout 34.

Opening 223 is similar to opening 22 of FIG. 4, and particularly comprises a first ramp 233 and a second ramp 243 which meet at the front central apex 273.

The operation of the apparatus will now be described. Beginning with the centered position shown in FIG. 15, one assumes that jaw 6 pivots towards the right, in the direction of arrow 12, around axis III, as a result of bias forces exerted by the boot. In the course of this pivoting, spur 263 moves along second ramp 243, in the direction of a second apex 293 of the opening. The spur has no mechanical action on lever 30, while the lever remains in the centered position. When jaw 6 is pivoted, for example in the position shown in FIG. 16, spur 263 is spaced from the first ramp 233, such that lever 30 can freely pivot towards the right the binding, in the direction of arrow 12, around its shaft 32, until reaching an extreme position in which ramp 233 will come to abut against spur 263.

The advantage of this embodiment having a lever is to take advantage of the multiplier effect of the lever to render the extent of movement of the anti-friction plate 1 substantially greater than the displacement of spur 263 or of opening 223. In practice, as shown in FIG. 17, a relatively small rotation of jaw 6 allows for a substantial movement of anti-friction plate 1, such that one must provide abutment means to limit the total extent of movement of the anti-friction plate and to avoid its escape outside of tracks 5.

FIG. 18 is a side cross-sectional view along IV—IV of FIG. 17.

The embodiments shown in FIGS. 19–27 likewise assure a linkage between jaw 6 and anti-friction plate 1 by means of distinct intermediate elements. In this case, the linkage is assured by two independent connecting rods forming a moveable abutment control by the jaw.

Figure 19:
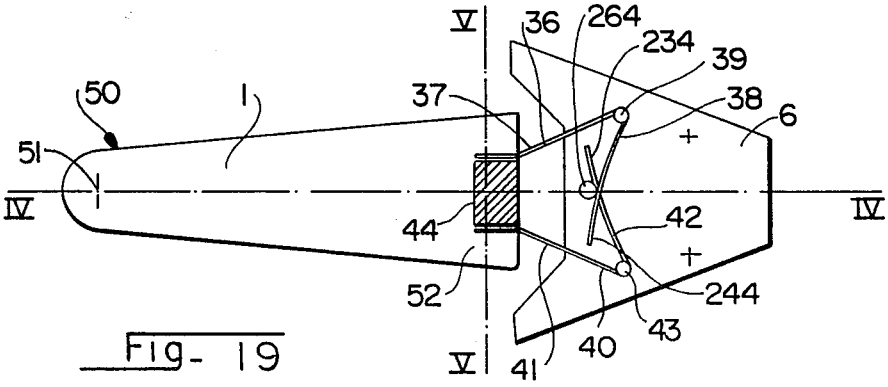
FIGS. 19–21 illustrate one embodiment for an abutment of the "engaging" type and rotatable anti-friction plate, the linkage between the jaw and the anti-friction plate being assured by connecting rods.
Figure 20:
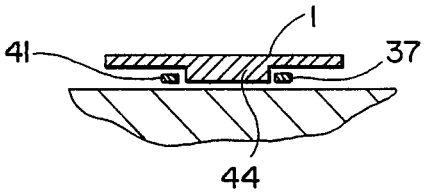
Figure 21:
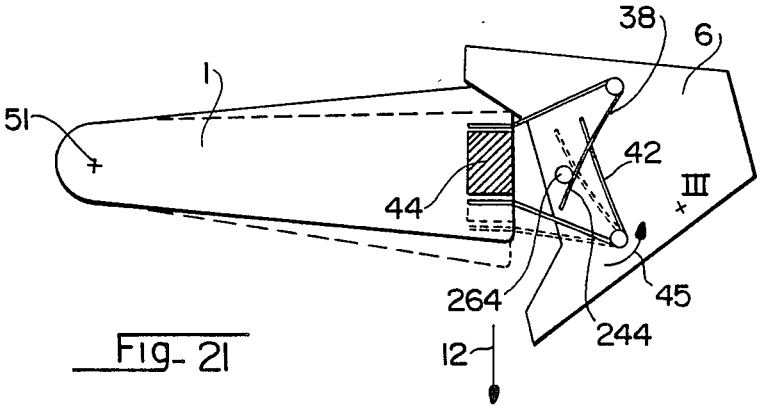
Figure 22:
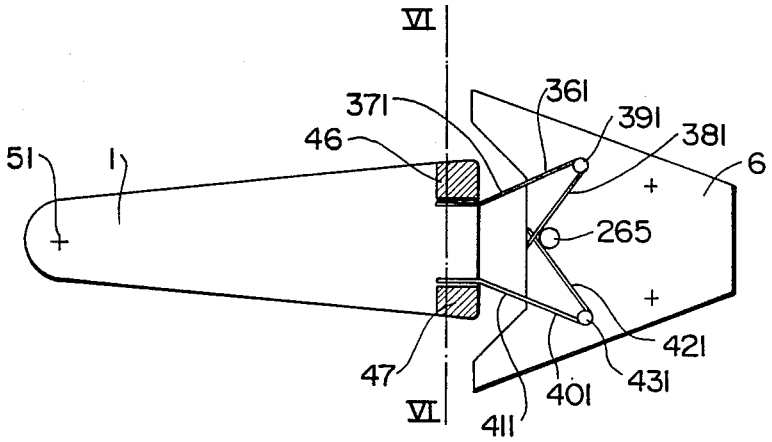
FIGS. 22–24 illustrate a similar embodiment having connecting rods for a binding of the "disengaging type"

Thus, in the embodiment shown in FIGS. 19–21, jaw 6 is of the "engaging" type, and carries a spur 264 in the centered position adjacent to its rear end. The binding comprises furthermore two connecting rods 36 and 40, each having two arms and an intermediate journal, positioned symmetrically with respect to the longitudinal median plane of the binding, as shown in FIG. 19. Thus, connecting rod 36 comprises a first arm 37 oriented towards the rear of the binding, and a second arm 38 oriented towards the interior of the binding, and is journaled on a first vertical shaft 39 which is affixed to platform 3 of the binding and laterally offset from the median plane. Second connecting rod 40 comprises an arm 41 which extends towards the rear and a second arm 42 which extends towards the interior of the binding, and is journaled along a second vertical shaft 43 which is laterally offset along the platform.

FIG. 20 illustrates a schematic view in cross section along axis V—V of FIG. 19.

Ends of arms 37 and 40 form an abutment limiting the lateral movement of the anti-friction plate. For this, the lateral interior surfaces of the ends of arms 37 and 41 cooperate with a central shoulder 44 of the anti-friction plate 1. Arms 38 and 42 are oriented to be in front of spur 264, and their ends form two convex ramps 234 and 244 on both sides of spur 264. Portions 234 and 244 of arms 38 and 42 preferably have the same shape as ramps 23 and 24 of the opening of FIG. 4.

The operation of the apparatus will now be described. In the centered position, shown in FIG. 19, shoulder 44 is maintained on both sides by arms 37 and 41; arms 38 and 42 resting on both sides of spur 264. Beginning from this centered position, during a bias towards the right in the direction of arrow 12, jaw 6 pivots as is shown in FIG. 21. Spur 264 moves along the length of portion 244 of arm 38 without pressing on the arm because portion 244 is parallel to the normal trajectory of the spur. In the pivoted position shown in FIG. 21, spur 264 is spaced from arm 42, which can then pivot in the direction of arrow 45, which spaces arm 41 which then frees anti-friction plate 1 towards the right. Anti-friction plate 1 can then be displaced to reach a limit position shown in FIG. 21, in which it pushes arm 41 to the limit position in which arm 42 abuts against spur 264.

Figure 23:
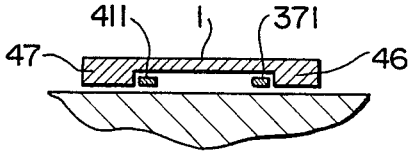

One can utilize in a similar manner connecting rods in the case of a binding of the "disengaging" type. Thus, in the embodiment shown in FIGS. 22–24, connecting rod 361 comprises an arm 371 forming an abutment for the anti-friction plate 1 and an arm 381 cooperating with a spur 265 affixed to jaw 6, the connecting rod being mounted on shaft 391. Likewise, connecting rod 401 comprises an arm 411 forming an abutment for the anti-friction plate and an arm 421 cooperating with spur 265, the connecting rods being journaled on a shaft 431. Arms 381 and 421 are oriented to be supported from the rear against spur 265, as shown in the Figure. Arms 381 and 421 constitute two ramps, similar to ramps 230 and 240 of FIG. 8, i.e., parallel to the trajectory which the spur follows during the pivoting of the jaw. Arms 371 and 411 cooperate, through their exterior lateral surface, with the lateral interior surface of a lateral corresponding shoulder of the anti-friction plate 1. Thus, arm 371 cooperates with lateral shoulder 46, and arm 411 cooperates with a lateral shoulder 47. FIG. 23 illustrates in schematic view a cross-section along axis VI—VI of FIG. 22.

Figure 24:
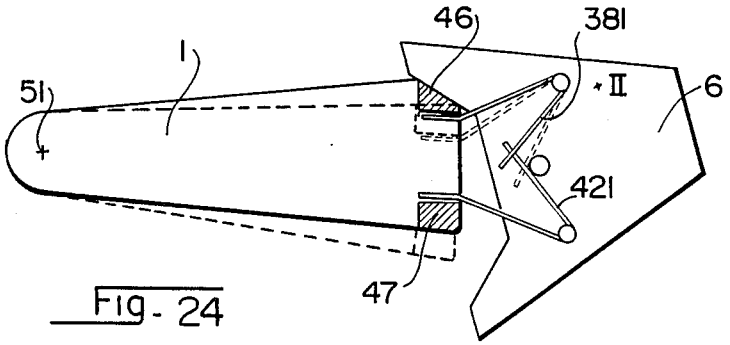

The operation will now be described. In the centered position shown in FIG. 22, spur 265 rests against arms 381 and 421 such that arms 371 and 411 rest against shoulders 46 and 47. During pivoting of jaw 6, as shown in FIG. 24, spur 265 moves along the length of arm 421, and frees arm 381 which then allows for the displacement of anti-friction plate 1.

The preceding embodiment applies likewise to the case of a binding having a single vertical axis. In this embodiment, shown in FIGS. 25–27, arms 382 and 422 cooperate with spur 266. The arms have a portion in the form of an arc of a circle to form, in the centered position shown in FIG. 25, two consecutive circular portions centered on the rotational axis I of jaw 6. Arms 382 and 422 are extended beyond their circular portion, as the figures show. During the rotation of jaw 6, spur 266 moves along the circular portions of the two arms, and allows for the pivoting of one of the connecting rods and of the anti-friction plate, as shown in FIG. 27.

In the embodiment shown in FIGS. 19–27, the anti-friction plate 1 is pivotally mounted, along its first end 50, around a vertical fixed axis 51. Axis 51 can be affixed to the ski, or affixed to the binding. The second end 52 of the anti-friction plate 1 thus allows for a lateral movement with respect to the vertical median plane IV—IV of the binding, by rotation around axis 51.

These same embodiments having linkage through connecting rods of FIGS. 19–27 can likewise be applied to anti-friction plates which are mounted for slidable translational movement on guides, as in the embodiments of FIGS. 4–18.

Likewise, the embodiments having a spur and opening for the linkage elements between the jaws and the anti-friction plates of FIGS. 4–18 can be applied to the pivoting anti-friction plates such as shown in FIGS. 19–27.

Figure 28:
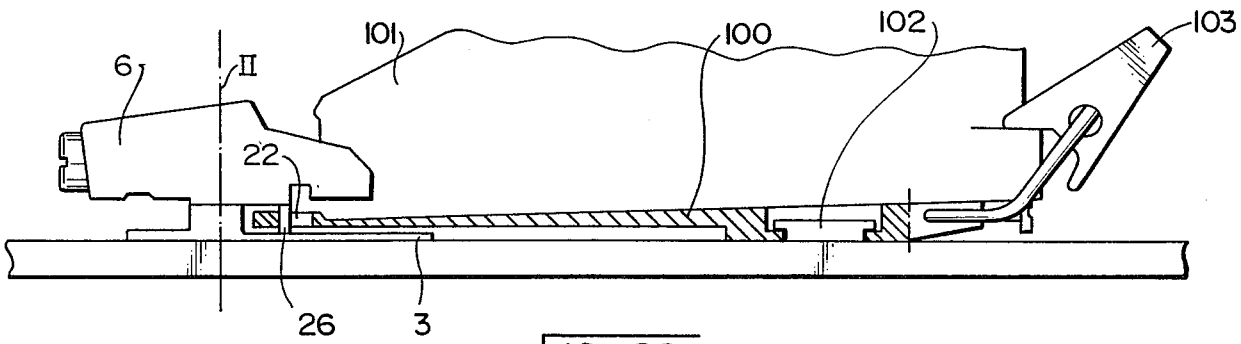
FIGS. 28 and 29 illustrate one particular embodiment of the anti-friction plate.
Figure 29:
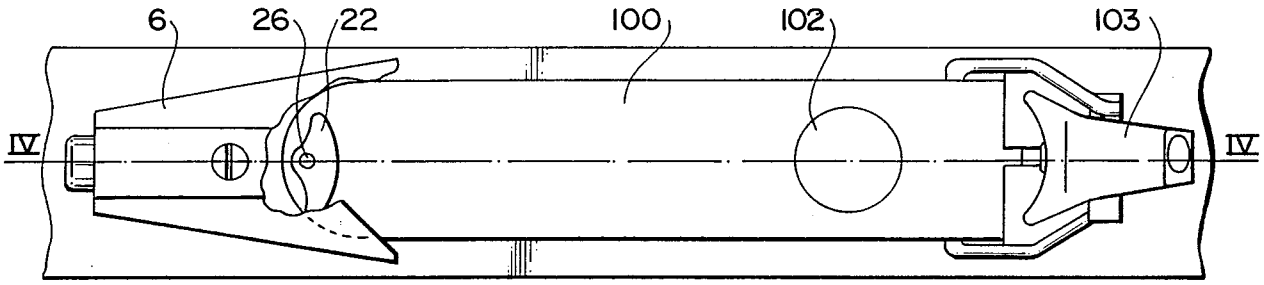

The embodiments having a pivotable anti-friction plate making it possible to provide relatively long plates, can form a support for a large portion of the boot sole, even for the total sole. Thus, in the embodiment shown in FIGS. 28 and 29, the linkage between the plate and the jaw through spur 26 and opening 22 according to the present invention is applied to a rotatable plate 100, of length greater than that of the sole of boot 101 to support the entire sole. Plate 100 is journaled around an axis 102 positioned under the heel of the boot and its rear end carries heel binding 103 which maintains boot 101 pressed on plate 100 and resting against jaw 6.

In all of the embodiments according to the invention, the anti-friction plates may partially or totally be covered with anti-adhesive means, for example a plate of polytetrafluoroethylene or any other appropriate means.

If desired, any appropriate means may be interposed between the lower surface of plate 1 and slides 5 or upper surface of platform 3, to allow for the relative sliding of these two elements. Such means can in particular be a plate made of polytetrafluoroethylene, rotatable rollers, etc.

In each of the embodiments which have been described, it is understood that the pivoting of jaw 6 towards the exterior does not cause the pivoting or the displacement of anti-friction plate 1. However, only the pivoting of jaw 6 towards the exterior allows for the possible displacement of the anti-friction plate 1. Thus, if anti-friction plate 1 is blocked or braked by ice which forms between its lower surface and the upper surface of the ski, the pivoting of jaw 6 is not disturbed by the presence of this ice. The upper surface of the anti-friction plate 1 thus operates as a conventional anti-friction surface on which the sole of the boot slides. In the absence of ice between the anti-friction plate and the ski, the boot transversely displaces the anti-friction plate 1 at the same time that it biases jaws 6. The pivoting or the lateral displacement of the anti-friction plate during purely torsional release does not require, with respect to the boot, any supplemental force, because the anti-friction plate is freed to be transversely displaced until a release position of the binding in which the boot escapes from jaw 6. No energy with respect to the anti-friction plate disturbs the release of the binding.

When jaw 6 returns to the stable centered maintenance position under the action of its own elastic means, the linkage means between the jaw and the anti-friction plate progressively limit the possible transverse extent of movement of the anti-friction plate. If the anti-friction plate 1 has been displaced the linkage means assure the automatic recentering of the anti-friction plate.

Although the invention has been described with respect to particular means, materials and embodiments, it is to be understood that the invention is not limited to the particulars disclosed and extends to all particulars within the scope of the claims.

We claim:

1. A safety binding for a ski adapted to maintain, in a laterally releasable fashion, a boot with respect to a ski, said binding comprising:

a jaw adapted to retain one end of the boot and to transversely free it under the effect of forces greater than a predetermined threshold, the jaw being moveably mounted to pivot on a platform to both sides of a stable centered equilibrium position towards which it is elastically biased by elastic return means;

an anti-friction plate positioned for lateral movement, adapted to be placed in a sliding zone on the upper surface of the ski adjacent to said jaw to support the sole of the boot; said anti-friction plate being guided by vertical and longitudinal guidance means for allowing a free lateral movement of said anti-friction plate relative to a centered position;

first and second extent limiters for limiting the free lateral extent of movement of the anti-friction plate on both sides of the centered position which respectively define first and second extreme positions of the anti-friction plate, said first and second extent limiters being movable and being controlled by said jaw whereby each extreme lateral position of the anti-friction plate has, with respect to the longitudinal median plane of the binding, a spacing which increases only in proportion to the extent of lateral pivoting of the jaw along the same transverse direction with respect to the centered equilibrium position of said jaw, such that only the pivoting of the jaw towards the exterior frees the anti-friction plate in the same direction while not itself moving said anti-friction plate, and whereas said jaw and plate are operatively associated whereby return of said jaw towards said equilibrium position recenters the anti-friction plate.

2. A safety binding as defined by claim 1 wherein in the stable centered equilibrium position of the boot, the first and second extent limiters maintain the anti-friction plate with substantially no play in the centered position.

3. The safety binding as defined by claim 1 wherein the binding is of the "engaging" type wherein the binding retracts from the front of the ski during pivoting, having two laterally offset pivot axes, the jaw comprising a spur having a substantially vertical axis positioned at the rear portion of said jaw, engaged in an opening which is laterally movable with the anti-friction plate, said opening comprising two lateral oblique ramps which diverge away from the jaw, said ramps joining at a central front apex and serving to define the extent of movement that said spur follows during the movements of the boot, such that, when the jaw is in the equilibrium position, the spur is positioned in the central apex of the opening, and when the jaw pivots starting at its equilibrium position towards a lateral release position, the opening remains fixed, and the spur moves along the lateral corresponding oblique ramp of the opening without exerting a substantial mechanical action on this ramp, whereupon the lateral extent of movement of the anti-friction plate is limited between the two extreme positions at which one or the other of the lateral oblique ramps contacts the spur, the spur assuring the return to the centered position of the anti-friction plate during the return of the jaw to the equilibrium position.

4. The safety binding as defined by claim 3, wherein said opening is positioned directly on the anti-friction plate itself.

5. The safety binding as defined by claim 1, wherein the binding is of the "disengaging" type, wherein the jaw advances towards the front of the ski during pivoting, having two laterally offset pivot axes, the jaw comprising a spur having a substantially vertical axis positioned to the rear of the jaw, engaged in an opening of appropriate shape which is laterally movable with the anti-friction plate, the opening comprising two lateral and oblique ramps, which diverge towards the front of the binding beginning at a rear central apex, said ramps defining the extent of movement of said spur during the movements of the jaw, such that, when the jaw is in the equilibrium position the spur is positioned in the central apex of the opening, and when the jaw pivots from the equilibrium position towards a lateral release position, the spur moves along the corresponding lateral oblique ramp of the opening without exerting a substantial mechanical action on this ramp, the lateral movements of the anti-friction plate being limited between two extreme positions in which one or the other of the lateral oblique ramps of the opening contacts the spur, the spur assuring the return to the centered position of the anti-friction plate during the return of the jaw to the equilibrium position.

6. The safety binding as defined by claim 5, wherein said opening is provided on the anti-friction plate itself.

7. The safety binding as defined by claim 5, wherein said opening is provided in an intermediate lever pivotably mounted along its first end on a vertical shaft affixed to a platform of the binding, the second end of said lever cooperating with the anti-friction plate to which it is affixed for transverse displacement.

8. The safety binding as defined by claim 1, wherein the binding is of the "engaging" type, wherein the jaw retracts from the front of the ski during pivoting, having two laterally offset pivot axes, the safety binding comprising a spur of a substantially vertical axis, which is laterally movable with the anti-friction plate, said spur engaged in an opening of appropriate shape provided in the posterior portion of said jaw, the opening comprising two ramps which are lateral and oblique and diverge from one another towards the front beginning at a rear central apex, the ramps moving during the movements of the jaw, and wherein when the jaw is in the equilibrium position the spur is positioned at the central apex of the opening, and when the jaw pivots from the equilibrium position to a lateral release position, the spur remaining fixed, the corresponding lateral oblique ramp of the opening moves past the spur without exerting a substantial mechanical effect on the spur, and the lateral movements of the anti-friction plate are limited between two extreme positions in which the spur respectively abuts against one or the other of the lateral oblique ramps of the opening, the ramps assuring the return to the centered position of the spur and of the anti-friction plate during the return of the jaw to the equilibrium position.

9. The safety binding as defined by claim 1, wherein the binding is of the "disengaging" type, wherein the jaw advances towards the front of the ski during pivoting, having two laterally offset pivot axes, the binding comprising a spur having a substantially vertical axis, which is laterally movable with the anti-friction plate which is engaged in an opening of appropriate shape provided in the rear of said jaw, the opening comprising lateral and oblique ramps which extend into secondary ramps and diverge from one another towards the rear beginning at a front central apex, the lateral ramps moving past and adjacent to the centered position of the spur during lateral movements of the jaw, whereby when the jaw is in the equilibrium position toward a lateral release position, the corresponding lateral oblique ramp of the opening moves past the spur without exerting a substantial mechanical effect on the spur, the lateral movement of the anti-friction plate thus being limited between two extreme positions in which the spur rests respectively on one or the other of the oblique lateral or secondary ramps of the opening, the ramps assuring the return to the centered position of the spur and of the anti-friction plate during the return of the jaw to the equilibrium position.

10. The safety binding as defined by claim 9 wherein said spur is positioned directly on the anti-friction plate.

11. The safety binding as defined by claim 3, wherein said opening is provided in an intermediate lever pivotably mounted along its first end on a vertical shaft affixed to said platform of the binding, the second end of said lever cooperating with the anti-friction plate and being affixed thereto for transverse displacement.

12. The safety binding as defined by claim 8, wherein said spur is provided on an intermediate lever pivotably mounted along its first end on a vertical fixed axis of a platform of the binding the second end of said intermediate lever cooperating with the anti-friction plate to which it is affixed for transverse displacement.

13. The safety binding as defined by claim 9, wherein said spur is provided on an intermediate lever pivotably mounted along its first end on a vertical fixed axis of a platform of the binding, the second end of said intermediate lever cooperating with the anti-friction plate to which it is affixed for transverse displacement.

14. The safety binding as defined by claim 1, wherein the anti-friction plate is freely slidably mounted on transverse guides comprising said vertical and longitudinal guide means.

15. The safety binding as defined by claim 1, wherein the anti-friction plate is freely pivotably mounted around a fixed axis.

16. The safety binding as defined by claim 15, wherein the anti-friction plate carries a heel binding at its rear end, said anti-friction plate being journalled along an axis positioned at the heel of the boot, said anti-friction plate having a length sufficient to support the entire sole of the boot.

17. The safety binding as defined by claim 1, wherein the binding is of the single pivot "disengaging" type, wherein the jaw advances towards the front of the ski during pivoting, having two laterally offset pivot axes and comprises two extent limiters positioned facing one another on both sides of the longitudinal median plane of the binding, each extent limiter comprising a first arm of a connecting rod having two affixed arms, said connecting rod being pivotably mounted along an intermediate portion on a vertical fixed axis extending from a binding platform, the first arm cooperating through its lateral exterior surface with the interior lateral surface of a corresponding lateral shoulder of the anti-friction plate, the second arm being oriented to rest at the rear against said spur positioned at the rear portion of said jaw, the second arm being configured to define the extent of movement of the spur during the pivoting of the jaw in its direction.

18. The safety binding as defined in claim 1, wherein the binding is of the "engaging" type, wherein the binding retracts from the front of the ski during pivoting, having two laterally offset pivot axes, said binding comprising two extent limiters positioned facing one another on both sides of the longitudinal median plane of the binding, each extent limiter comprising a first arm of a connecting rod having two affixed arms, pivotably mounted along its intermediate portion on a vertical fixed axis extending from a binding platform, the first arm cooperating through its interior lateral surface with the exterior lateral surface of a corresponding central shoulder of the anti-friction plate, the second arm being oriented to rest in front against a spur positioned at the rear portion of said jaw when said jaw is in said equilibrium position, the second arm being configured to define the extent of movement which the spur follows during the pivoting of the jaw in the opposite direction.

19. A safety binding comprising:

(a) a pivotable jaw adapted to pivot from stable equilibrium position to release a ski boot, said pivotable jaw being biased for return to said stable equilibrium position;

(b) an anti-friction plate adapted for lateral movement transverse to the longitudinal median plane of the jaw; and (c) extent limiting means allowing for free lateral movement of said anti-friction plate only upon lateral pivoting of said jaw, said extent limiting means defining the maximum extent of possible lateral movement of said anti-friction plate.

20. The safety binding as defined by claim 19 wherein said extent limiting means further recenters said anti-friction plate upon return of said jaw to its stable equilibrium position.

21. The safety binding as defined by claim 20 wherein said binding is of the "engaging" type wherein the jaw retracts from the front of the ski during pivoting.

22. The safety binding as defined by claim 20 wherein said binding is of the "disengaging " type wherein the jaw advances towards the front of the ski during pivoting.

23. The safety binding as defined by claim 22 wherein said binding is of the single pivot "disengaging" type wherein the jaw advances towards the front of the ski during pivoting.

24. The safety binding as defined by claim 20 wherein said extent limiting means comprises a spur mounted on one of said jaw or said anti-friction plate, said spur cooperating with an opening on the other of said jaw or said anti-friction plate whereby upon pivoting of said jaw from its stable equilibrium position said spur and opening move freely relative to one another whereby substantially no lateral forces are exerted on said anti-friction plate.

25. The safety binding as defined by claim 24 whereby said spur abuts against the surface forming the opening upon movement of said anti-friction plate to either of the maximum lateral extents of movement of said anti-friction plate.

26. The safety binding as defined by claim 25 wherein said binding is of the "engaging" type wherein said jaw retracts from the front of the ski during pivoting.

27. The safety binding as defined by claim 26 wherein said opening is generally triangular and is located in a forward extension of said anti-friction plate.

28. The safety binding as defined by claim 27 wherein said opening comprises convex lateral oblique ramps meeting at a forward apex.

29. The safety binding as defined by claim 28 wherein said spur depends downwardly from said jaw and extends into the apex of said opening.

30. The safety binding as defined by claim 26 wherein said generally triangular opening is located on said jaw, and wherein said anti-friction plate has a frontward extension having a spur extending vertically upwardly therefrom to extend within said opening in said jaw.

31. The safety binding as defined by claim 30 wherein said generally triangular opening comprises two lateral oblique concave ramps converging rearwardly to an apex, and wherein said spur extends upwardly to within said apex when said jaw is in said stable equilibrium position.

32. The safety binding as defined by claim 25 wherein said binding is of the "disengaging" type wherein said jaw advances towards the front of the ski during pivoting.

33. The safety binding as defined by claim 32 wherein said opening is a generally triangular opening in a frontward extension of said anti-friction plate, and wherein said spur extends downwardly from said jaw into said opening.

34. The safety binding as defined by claim 33 wherein said generally triangular opening has two converging lateral concave oblique walls which converge towards an apex away from the front of said jaw, said spur being positioned within said apex when said jaw is in said stable equilibrium position.

35. The safety binding as defined by claim 32 wherein said opening is generally triangular, having rounded base angles, and oblique lateral ramps converging towards the front to form an apex, said opening being formed in said jaw, and wherein said spur vertically extends and is secured to move with a frontward extension of said anti-friction plate, said spur extending upwardly to be positioned in the apex of said opening when said jaw is in the stable equilibrium position.

36. The safety binding as defined by claim 19 wherein said extent limiting means comprises a linkage lever having first and second openings therein, said first opening being generally triangular with two lateral oblique walls converging towards an apex, and a second opening adjacent to said anti-friction plate, said anti-friction plate comprising a spur extending upwardly into said second opening to allow for longitudinal movement of said spur on said anti-friction plate in said second opening, said extent limiting means further comprising a second spur extending from said jaw into said first opening.

37. The safety binding as defined by claim 20 wherein said anti-friction plate can slide laterally only relative to the longitudinal median plane of said binding.

38. The safety binding as defined by claim 20 wherein said anti-friction plate can slide laterally while pivoting around an axis generally perpendicular to the upper surface of the ski.

39. The safety binding as defined by claim 38 wherein said anti-friction plate extends substantially the entire length of the sole of said ski boot.

40. The safety binding as defined by claim 39 wherein said anti-friction plate comprises a heel binding movable with said anti-friction plate for securing the rear of said ski boot to a ski.

41. The safety binding as defined by claim 40 wherein said anti-friction plate comprises an opening at the end thereof opposite from said heel binding, and wherein said jaw comprises a spur extending therefrom into said opening, said opening and spur constituting said extent limiting means.

42. The safety binding as defined by claim 38 wherein said extent limiting means comprises a pair of connecting rods, a spur and at least one cooperating shoulder on said anti-friction plate, said pair of connecting rods being symmetrically positioned and pivotably mounted on opposite sides of the longitudinal median plane of said jaw, each of said connecting rods comprising first and second arms, each of said first arms cooperating with a shoulder of said anti-friction plate, with each of said second arms being configured to cooperate with said spur to determine the maximum extent of lateral movement of said anti-friction plate.

43. The safety binding as defined by claim 42 wherein said binding is of an "engaging" type wherein said jaw retracts from the front of the ski during pivoting.

44. The safety binding as defined by claim 43 wherein said first arms are configured and positioned to cooperate with exterior lateral surfaces of said at least one shoulder which is centrally positioned on said anti-friction plate.

45. The safety binding as defined by claim 42 wherein said binding is of the "disengaging" type wherein said jaw advances towards the front of the ski during pivoting.

46. The safety binding as defined by claim 45 wherein said first arms cooperate with lateral interior surfaces of opposite shoulders on said anti-friction plate.

47. The safety binding as defined by claim 46 wherein said binding is a single pivot binding.

48. A safety binding for a ski adapted to maintain, in a laterally releasable fashion, a boot with respect to a ski, said binding comprising:

a jaw adapted to retain one end of the boot and to transversely free it under the effect of forces greater than a predetermined threshold, the jaw being moveably mounted to pivot on a platform to both sides of a stable centered equilibrium position towards which it is elastically biased by elastic return means;

an anti-friction plate positioned for lateral movement, adapted to be placed in a sliding zone on the upper surface of the ski adjacent to said jaw to support the sole of the boot; said anti-friction plate being guided by vertical and longitudinal guidance means for allowing a free lateral movement of said anti-friction plate relative to a centered position in response to a torsional force;

first and second extent limiters for limiting the free lateral extent of movement of the anti-friction plate on both sides of the centered position which respectively define first and second extreme positions of the anti-friction plate, said first and second extent limiters being movable and being controlled by said jaw whereby each extreme lateral position of the anti-friction plate has, with respect to the longitudinal median plane of the binding, a spacing which increases in proportion to the extent of lateral pivoting of the jaw along the same transverse direction with respect to the centered equilibrium position of said jaw, such that the pivoting of the jaw towards the exterior frees the anti-friction plate in the same direction while not itself moving said anti-friction plate, and whereas said jaw and plate are operatively associated whereby return of said jaw towards said equilibrium position re-centers the anti-friction plate.

49. A safety binding composition:

(a) a pivotable jaw adapted to pivot from stable equilibrium position to release a ski boot, said pivotable jaw being biased for return to said stable equilibrium position;

(b) an anti-friction plate adapted for lateral movement transverse to the longitudinal median plane of the jaw; and (c) extent limiting means allowing for free lateral movement of said anti-friction plate in response to a torsional force upon lateral pivoting of said jaw, said extent limiting means defining the maximum extent of possible lateral movement of said anti-friction plate.

* * * * *

UNITED STATES PATENT AND TRADEMARK OFFICE

CERTIFICATE OF CORRECTION

PATENT NO. : 4,869,525

DATED : September 26, 1989

INVENTOR(S) : Yvon GALLET et al.

It is certified that error appears in the above-identified patent and that said Letters Patent is hereby corrected as shown below:

Column 1, line 59, after "spring" insert ---.---.
Column 6, line 18, change "rampes" to ---ramps---.
Column 6, line 48, after "pivots" insert ---.---.
Column 6, line 55, after "platform" insert ---.---.
Column 9, line 35, change "4147" to ---4-7---.
Column 10, line 16, change "al" to ---all---.
Column 11, line 43, change "a" to ---an---.
Column 12, line 8, after "right" insert ---of---.
Column 17, line 10, after "binding" insert ---,---.
Column 20, line 54, change "composition" to ---comprising---.

Signed and Sealed this

First Day of October, 1991

*Attest:*

HARRY F. MANBECK, JR.

*Attesting Officer*

*Commissioner of Patents and Trademarks*